US005332491A

United States Patent [19]

Fisher et al.

[11] Patent Number: 5,332,491

[45] Date of Patent: Jul. 26, 1994

[54] IRON SULFIDE DISPERSING AGENTS

[75] Inventors: Sherri L. Fisher, Sugarland; Bradley D. Mercer, Houston, both of Tex.

[73] Assignee: Nalco Chemical Company, Naperville, Ill.

[21] Appl. No.: 57,506

[22] Filed: May 4, 1993

[51] Int. Cl.[5] ..... C10G 17/10; C07C 7/00

[52] U.S. Cl. ..... 208/251 R; 208/47; 208/48 AA; 585/833; 585/866; 585/3

[58] Field of Search ..... 208/22, 108, 68, 47, 208/48 AA, 251 R; 252/560, 48.6, 51.5, 8.552, 56 R; 585/3, 833, 866; 44/62, 331

[56] References Cited

U.S. PATENT DOCUMENTS

| | | | |
|---|---|---|---|
| 3,231,458 | 1/1966 | Lawson | 161/162 |
| 3,531,440 | 9/1970 | Mehmedbasich et al. | 260/78.4 |
| 3,560,456 | 2/1971 | Hazen et al. | 260/78.5 |
| 3,694,176 | 9/1972 | Miller | 44/62 |
| 4,151,069 | 4/1979 | Rossi | 208/33 |
| 4,240,916 | 12/1980 | Rossi | 252/56 D |
| 4,548,725 | 10/1985 | Bridger | 252/56 R |
| 4,866,135 | 9/1989 | Gutierrez et al. | 525/285 |
| 4,919,683 | 4/1990 | Nalesnik et al. | 44/62 |
| 5,073,248 | 12/1991 | Stephenson et al. | 208/22 |
| 5,214,224 | 5/1993 | Comer et al. | 585/3 |

FOREIGN PATENT DOCUMENTS 62-18494 1/1987 Japan .

OTHER PUBLICATIONS

Speight, James G., *The Chemistry and Technology of Petroleum*, Marcel Dekker, Inc., New York (1991) p. 249.

*Primary Examiner*—Asok Pal
*Assistant Examiner*—Bekir L. Yildirim
*Attorney, Agent, or Firm*—Robert A. Miller; James J. Drake

[57] ABSTRACT

A method is disclosed for dispersing iron sulfide in hydrocarbon streams found in refinery and petrochemical plant operations. The dispersant comprises a free radically polymerized copolymer of an α-olefin of from about 10 to about 36 carbon atoms and maleic anhydride wherein the anhydride moieties along the copolymer backbone are substantially unhydrolyzed. The copolymer has a ratio of α-olefin to maleic anhydride of from about 1 to about 5 and a molecular weight of from 5000 to about 100,000.

6 Claims, No Drawings

IRON SULFIDE DISPERSING AGENTS

FIELD OF THE INVENTION

The present invention relates to dispersing iron sulfide present in refinery and chemical plant process streams with α-olefin/maleic anhydride copolymer additives.

BACKGROUND OF THE INVENTION

In the refining of crude oil and the manufacture of chemicals the formation of iron sulfide often presents operational and maintenance problems. Accumulation of iron sulfide deposits can accumulate in heat exchangers, reactor beds, tower trays and other process equipment. Such accumulations decrease efficiency and eventually require taking the equipment out of service for removal of the deposits.

Products such as poly(isobutenyl) succinimides are known as 20 dispersants for hydrogen sulfide in process streams. These products, unlike the present invention, contains nitrogen which acts as a catalyst poison in some operations. In addition, higher concentrations of the products are required to disperse iron sulfide than are required with the instant invention.

Polymers comprising α-olefins and maleic anhydride are well known. Rossi U.S. Pat. No. 4,240,916 discloses an oil soluble copolymer composed of about equimolar amounts of 1-olefins and maleic anhydride useful as a lubricating oil pour point depressant wherein the 1-olefins are a mixture of $C_{10}$–$C_{14}$ and $C_{20}$–$C_{28}$ monomers. The pour point depressant activity is said to be enhanced by esterification of the copolymer with a $C_1$–$C_4$ alcohol.

Rossi U.S. Pat. No. 4,151,069 discloses olefin dicarboxylic anhydride copolymers and their ester derivatives having $C_{18}$–$C_{50}$ linear alkyl side chains. The polymers and derivatives are said to be useful in amounts of up to 5 weight percent as filtration aids in low temperature solvent dewaxing of waxy lubricating oils containing 5–30 weight percent wax.

Similarly, U.S. Pat. No. 3,694,176 to Miller, discloses polymers of ethylene and ethylenically unsaturated dicarboxylic acids, anhydrides or esters as wax crystal modifiers, pour point depressants and dewaxing aids in petroleum oil.

Rossi U.S. patent application Ser. No. 515,562, filed Oct. 17, 1974, abandoned, discloses that partial alkyl ester-partial amide derivatives of low molecular weight maleic anhydride/1-olefin copolymers are useful in mineral oil lubricants as pour point depressants, viscosity index improvers and sludge inhibitors.

Japanese Kokai 62-018,494 discloses low temperature flow improvers for fuel oils which are copolymers of a $C_{20}$–$C_{28}$ α-olefins and maleic anhydride.

U.S. Pat. No. 3,560,456 to Hazan et al. discloses a process for making a copolymer of maleic anhydride and an aliphatic olefin having from 16–18 carbon atoms in the presence of a free radical catalyst and a solvent. The copolymer is precipitated from solution using n-propanol or isopropanol.

U.S. Pat. No. 3,231,458 to de Vries discloses a high molecular weight copolymer of α-olefins of from about 2 to about 20 carbon atoms and diolefins of from about 5 to about 20 carbon atoms reacted with maleic anhydride to form a succinic anhydride-substituted adduct said to have rust inhibiting, dispersing and thickening characteristics in liquid hydrocarbon compositions, such as fuels and lubricants.

U.S. Pat. No. 4,919,683 to Nalesnik, et al. discloses a stabilizer for a middle distillate fuel-oil which is an aromatic polyamine succinimide derivative of an ethylene/$C_3$–$C_{18}$ α-olefin copolymer grafted with maleic anhydride.

U.S. Pat. No. 4,866,135 to Gutierrez et al. discloses a reaction product of a $C_5$–$C_9$ lactone adduct of a maleic anhydride grafted ethylene/$C_3$–$C_{28}$ α-olefin polymer with an N-containing heterocyclic aminoalkyl derivative. The polymeric lactone derivatives are said to be useful as dispersant additive for fuel and lubricating oils.

U.S. Pat. No. 4,548,725 to Bridger discloses a lubricant additive said to reduce low temperature microcrystalline wax formation in hydro-dewaxed stock made by reacting an alcohol with a maleic anhydride-olefin copolymer.

U.S. Pat. No. 3,531,440 to Mehmedbasich et al. discloses succinate ester modified polymers of $C_6$–$C_{18}$ α-olefins employed as H dispersants in fuels.

SUMMARY OF THE INVENTION

It has been discovered that iron sulfide in hydrocarbon streams can be effectively dispersed using a free-radically polymerized copolymer of an α-olefin and maleic anhydride. In untreated streams iron sulfide precipitates in lines and equipment causing operational difficulties and/or excessive maintenance problems.

The present invention provides a method for dispersing iron sulfide in a hydrocarbon stream. The method comprises introducing an effective amount of a dispersant into the iron sulfide containing hydrocarbon stream.

The dispersant comprises a copolymer of an α-olefin having from about 10 to about 36 carbon atoms and maleic anhydride. The weight ratio of the α-olefin to the maleic anhydride in the copolymer is from about 1:1 to about 1:5. The molecular weight of the copolymer is from about 5,000 to about 100,000. The anhydride moieties of the copolymer may be partially hydrolyzed.

The dispersant preferably comprises an α-olefin having from about 24 to about 28 carbon atoms or a mixture of such olefins, a weight ratio of α-olefin to maleic anhydride of from about 1:1 to about 1: 2, and a weight average molecular weight of from about 5000 to about 15,000.

DETAILED DESCRIPTION OF THE INVENTION

The dispersant of the present invention comprises an as-polymerized copolymer of an α-olefin and maleic anhydride wherein the anhydride moieties along the polymer backbone may be converted into a di-acid. In contrast to many other uses for polymeric maleic anhydride derivatives wherein the anhydride must generally be converted to an ester or amide derivative, it has been found, quite surprisingly that the copolymer of an α-olefin and maleic anhydride, essentially, free of such derivative ester and amide moieties, is very effective in dispersing iron sulfide in a hydrocarbon stream.

In the following description and claims, these copolymers will be referred to as SLF/BOM having anhydride moities. In the high temperature, anhydrous conditions of the treated process streams, any hydrolyzed moities (i.e., diacids) are believed to be converted back into the anhydride form. Thus, a polymer containing hydrolyzed maleic units will be converted into the anhydride form in situ.

Suitable α-olefin monomers have from about 10 to about 36 carbon atoms, preferably from about 18 to about 28 carbon atoms, and most preferably from 24 to about 28 carbon atoms. Examples of such α-olefins include 1-tetradecene, 1-hexadecene, 1-octadecene, 1-eicosene, 1-docosene, 1-tetracosene, 1-heptacosene, 1-triacontene, 1-hexatriacontene, and the like. Typically such α-olefins are provided commercially as mixtures of two or more adjacent homologues. Economically, such mixtures are preferred over the more expensive pure monomers. The preferred mixture is a mixture of $C_{24}$ to $C_{28}$ α-olefins.

Maleic anhydride is a preferred α,β-ethylenically unsaturated anhydride. The maleic anhydride should preferably be essentially free of maleic acid contamination.

The copolymer dispersant suitable for use in the present invention has a molar ratio of maleic anhydride to α-olefin of from about 1 to about 5, preferably from about 1 to about 2, and most preferably 1 to about 1.5. Copolymers typically have a molecular weight from about 5000 to about 100,000, preferably from 5000 to about 25,000, and more preferably from about 5000 to about 15,000. The copolymer dispersant is preferably substantially free of hydrolyzed anhydride moieties or any other anhydride reaction products.

The α-olefin/maleic anhydride copolymer dispersant is generally suitable for use in any iron sulfide containing hydrocarbon and halogenated hydrocarbon stream including refinery streams such as crude oil, light hydrocarbon plants streams, olefin plant streams and petrochemical or petrochemical derivative streams including for example ethylene dichloride and vinyl chloride which contain iron sulfide or in which iron sulfide may form. As used herein, iron sulfide containing stream includes both streams where iron sulfide is present and streams susceptible to its formation.

The present invention is generally applicable to hydrocarbons and halogenated hydrocarbons and mixtures found, for example, in various refinery units such as hydrodesulfurizers, reformers, hydrocrackers, and recovery units such as depropanizers and debutanizers; petrochemical units such as monomer plants, e.g. for ethylene, SLF/BOM styrene and butadiene; polymer production facilities, e.g. for polybutadiene and polyethylene; petrochemical derivative units such as alkylation units; and the like. Using the present invention, hydrogen sulfide can be dispersed in hydrocarbons in process equipment including, for example, coolers, heat exchangers and reboilers, compressors, distillation towers (e.g. deethanizers, depropanizers, debutanizers, depentanizers, etc.), solvent extraction towers, and the like.

The present dispersant is typically added to a continuous process stream at a point of relatively low pressure to achieve a desired equilibrium concentration throughout the process. In any process requiring compression of gaseous reactants such as, for example, the production of ethylene, propylene, polyethylene, and the like, the point of addition is preferably upstream of the compressor uptake. In processes where gaseous and liquid reactants, products and/or solvents are heated or cooled, e.g. in recovery operations for recycle and reuse following product finishing steps, the present dispersant is preferably added upstream of heat exchangers or coolers. The precise location of addition of the dispersant will vary from application to application and its determination is well within the skill of art.

The present dispersant can be used as a continuous additive in the hydrocarbon stream or can be added periodically to facilitate dispersal of iron sulfide in process equipment.

The α-olefin/maleic anhydride copolymer is preferably prepared by a neat free radical polymerization of the maleic anhydride and the α-olefin. Such polymerizations are known in the art. The polymerization can be initiated by any free radical producing compound. Example include peroxides, azo, and the like initiators well known in the art. A preferred initiator is t-butyl perbenzoate. It is known that free radical polymerizations of the a-olefin and maleic anhydride are essentially alternating linear chains of the component monomers. This is different from polymer manufacture via the "ene" reaction wherein an olefin main chain is formed with the maleic anhydride grafted to the chain terminal position.

The amount of initiator to employ depends largely on the reactivity of the initiator chosen at a given reaction temperature. Typically, the initiator concentration is between about 0.001 to about 0.20 moles initiator per mole of maleic anhydride monomer, preferably 0.05 to about 0.10 moles initiator per mole anhydride.

The polymerization temperature may vary between about 20° C. to about 200° C. depending upon the initiator used and the desired properties of the copolymer product. We have found that a polymerization temperature of from about 125° C. to about 175° C. to be preferred. The polymerization pressure may vary from under a partial vacuum up to several thousand psi. Atmospheric pressure to about 100 psi is preferred for lower equipment costs and ease of manufacture.

Suitable reaction time is usually sufficient time to substantially completely react the available maleic anhydride. Reaction time is typically from about 1 to about 24 hours.

The reaction medium should be a liquid at the temperature and pressure of the copolymerization reaction. Suitable solvents which can optionally be employed include liquid saturated and aromatic hydrocarbons having from about 6 to about 20 carbon atoms, halogenated hydrocarbons having from about 1 to about 5 carbon atoms and ketones having from about 3 to about 6 carbon atoms. In the practice of the present invention, a neat polymerization reaction is conducted in the heated α-olefin comonomer. Otherwise, it is desirable that a separate reaction solvent be compatible with the end use hydrocarbon stream.

Typically a solvent is added to the copolymer following polymerization to facilitate handling and application of the dispersant. The preferred solvent is heavy aromatic naphtha.

The present invention is further illustrated by way of the following examples.

EXAMPLE 1

An α-olefin/maleic anhydride copolymer was made in a batch reaction as follows: To a clean, dry, oxygen-free reactor vessel, 78.75 parts by weight (out of a total of 100) of $C_{24-28}$ α-olefin mixture was added and heated using steam to 149° C. During the heating step, the reactor was purged using nitrogen to remove any water present in the monomer. Repeated monomer samples were analyzed for water content until the water concentration was shown to be 10 ppm or less. The nitrogen purge, however, was continued until all the initiator was added. Following the purging of any water present, 20.82 parts by weight acid-free maleic anhydride was metered into the reactor under agitation and the reactor was reheated to 149° C. Lastly, 0.428 parts by weight t-butyl perbenzoate initiator was metered into the reactor over a time period of 2–3 hours. The reaction temperature was allowed to rise to about 165.5° C. before cooling water was applied to the reaction vessel. The reaction temperature was maintained between 154° C. and 165.5° C. However, if the temperature exceeded 165.5° C., initiator addition was halted until the temperature dropped to 149° C., then initiator addition was continued. Following the addition of all the initiator, the reaction was continued for 15 minutes or until the viscosity of the solution was >1300 cp or the temperature fell below 149° C. The weight average molecular weight was estimated at between about 10,000 and 20,000.

EXAMPLE 2

A copolymer, prepared as in Example 1 ("B") and a conventional poly(isobutenyl) succinimide dispersant ("A") diluted to 10% weight/weight solution in aromatic solvent, were tested and compared utilizing the following test method.

(a) Ten milliliters of hexanes, sparged with hydrogen sulfide are added to centrifuge tubes (12.5 ml).

(b) Each tube, except for the blank, is dosed with varying amounts of each dispersant.

(c) Two-hundred microliters of a 15% ferric naphthahate solution in toluene, are added to each tube, using an Eppendorf pipette, to form iron sulfide.

(d) After ten minutes the tubes are centrifuged at 2000 rpm for one minute.

(e) The various dosage levels of each dispersant are evaluated on a pass/fail basis. If iron sulfide is observed at the bottom of a tube the dispersant, at that dosage, is a failure. Borderline cases are noted.

| Dispersant | Test Results ppm[3] | Comments |
|---|---|---|
| Blank | — | fail |
| A[1] | 500 | fail |
| | 600 | fail |
| | 700 | fail |
| | 800 | fail |
| | 900 | borderline |
| | 950 | pass |
| | 1000 | pass |
| | 1500 | pass |
| | 2000 | pass |
| B[2] | 500 | borderline |
| | 550 | borderline/pass |
| | 600 | pass |
| | 650 | pass |
| | 700 | pass |
| | 750 | pass |
| | 1000 | pass |
| | 1500 | pass |
| | 2000 | pass |

1. Conventional dispersant comprising poly(isobutenyl) succinimide (30 weight % active ingredient).
2. Dispersant prepared according to Example 1 (15 weight % active ingredient).
3. Dosage based on product as formulated.

As can be seen from the above data, dispersant B, the present invention, is 30 to 40% more effective than dispersant A, the conventional product. Moreover, as stated earlier, the dispersant of this invention is made up of only carbon, hydrogen and oxygen. As a result, its utility is extended to operations where nitrogen containing compounds, such as the conventional dispersant, are undesirable.

The foregoing description of the invention is illustrated and explanatory thereof. Various changes in the materials, apparatus, and particular parts employed will occur to those skilled in the art. It is intended that all such variations within the scope and spirit of the appended claims be embraced thereby.

What is claimed is:

1. A method for dispersing iron sulfide in hydrocarbon and halogenated hydrocarbon streams, wherein the hydrocarbon stream contains iron sulfide precursors, the precursors being reactive with one another such that iron sulfide particles are immediately formed within the hydrocarbon streams when the precursors react, comprising:

providing a dispersant comprising a copolymer of an α-olefin having from about 10 to about 35 carbon atoms and mixtures thereof and maleic anhydride, wherein the weight ratio of said α-olefin to said maleic anhydride is from about 1:1 to about 1:5 and the weight average molecular weight of said copolymer is from about 5000 to about 100,000 ; and injecting the dispersant into a hydrocarbon stream.

2. The method of claim 1 wherein said α-olefin comprises a mixture of α-olefins from about 24 to about 28 carbon atoms.

3. The method of claim 1 wherein said weight ratio of said α-olefin to said maleic anhydride comprises from about 1:1 to about 1:2.

4. The method of claim 1 wherein the molecular weight of said copolymers ranges from about 5000 to about 15000.

5. The method of claim 1 wherein said copolymer contains at least some hydrolyzed anhydride moities prior to being injected.

6. A method of dispersing iron sulfide in a hydrocarbon or halogenated hydrocarbon stream comprising:

providing a dispersant comprising a copolymer of an α-olefin having from about 24 to about 28 carbon atoms and mixtures thereof and maleic anhydride, wherein the weight ratio of said α-olefin to said maleic anhydride is from about 1:1 to about 1:2 and the weight average molecular weight of said copolymer is from about 5000 to about 15000;

injecting said dispersant into a hydrocarbon or halogenated hydrocarbon stream either containing iron sulfide or susceptible to the formation of iron sulfide.

* * * * *